United States Patent [19]

Combs et al.

[11] 4,138,986

[45] Feb. 13, 1979

[54] HIGH EFFICIENCY FURNACE WITH LOW POLLUTING EMISSIONS

[75] Inventors: L. Paul Combs, Woodland Hills; Allan S. Okuda, Canoga Park; Larry H. Russell, Agoura, all of Calif.

[73] Assignee: The United States of America as represented by the Administrator of the U.S. Environmental Protection Agency, Washington, D.C.

[21] Appl. No.: 777,230

[22] Filed: Mar. 14, 1977

[51] Int. Cl.[2] ..... F24H 3/06

[52] U.S. Cl. ..... 126/116 R; 431/185

[58] Field of Search ..... 126/116 R, 110 R; 431/185

[56] References Cited

U.S. PATENT DOCUMENTS

| | | | |
|---|---|---|---|
| 353,994 | 12/1886 | Walker et al. | 415/204 |
| 1,956,603 | 5/1934 | Bailey | 126/110 R X |
| 1,994,184 | 3/1935 | Williams | 126/116 R |
| 2,075,587 | 3/1937 | Mesinger | 415/209 |
| 2,675,865 | 4/1954 | Betzer | 126/116 R X |
| 2,711,683 | 6/1955 | Ryder | 126/85 B X |
| 3,500,814 | 3/1970 | DeLancey | 126/116 R X |
| 3,906,925 | 9/1975 | Dyer | 126/85 B X |
| 4,038,963 | 8/1977 | Dingwall | 126/85 B |

OTHER PUBLICATIONS

"Design of an Optimum Distillate Oil Burner for Control of Pollutant Emissions" EPA—650/2—74—047, Jun., 1974.

*Primary Examiner*—William E. Wayner
*Assistant Examiner*—William E. Tapolcai, Jr.

[57] ABSTRACT

A domestic furnace for heating a fluid that is circulated through a residential building includes an oil burner, a firebox for combustion products of the burner, a heat exchanger and a flue. A conduit extending from outside of the building supplies outside air to the burner and to the flue through a pressure controlled damper; the combustion air supplied to the burner is filtered. The air inlet to the burner includes a damper that closes automatically when the burner is extinguished, to eliminate heat losses up the flue during furnace standby. Nitric oxide, carbon monoxide, unburned hydrocarbon, and smoke emissions are minimized by the design of the burner and firebox combination. A conventional type burner head is used, rather than a flame retention type, and its choke diameter is related quantitatively to the burner firing rate. In addition, the burner head has oversized, internal, peripheral air swirler vanes. The combustion air fan, an integral part of the burner, draws exterior air into the burner; it is designed to prevent coupling of combustion air flow spikes with combustion noise in the firebox. To reduce flame zone temperature and, thereby, to help minimize nitric oxide emissions, a substantial amount of heat is extracted from the firebox. The firebox is therefore uninsulated and has external radially-extending heat exchange fins in the heated fluid. It is matched in size and shape to the burners in order to optimize the reduction of emissions and of excess air requirements.

36 Claims, 12 Drawing Figures

FIG. 1
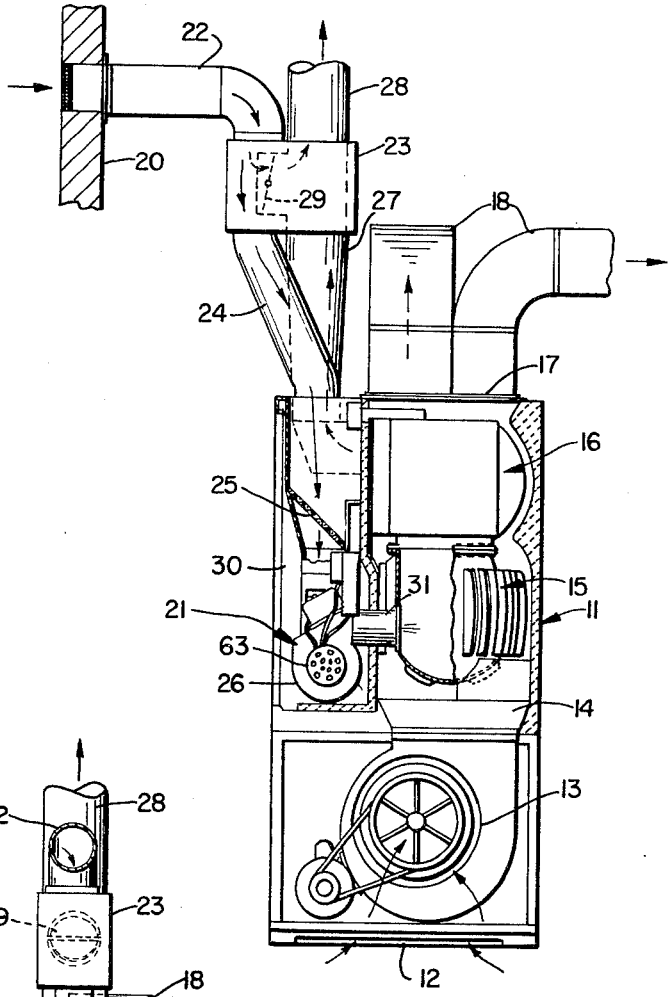
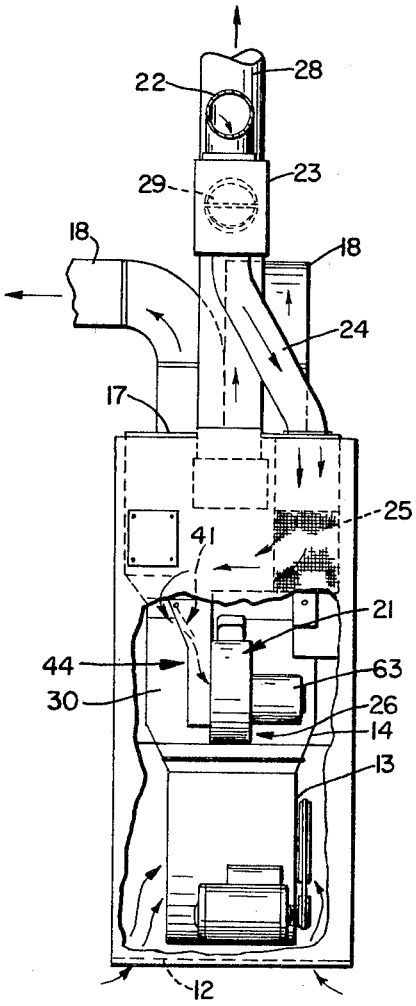
FIG. 2

FIG. 10
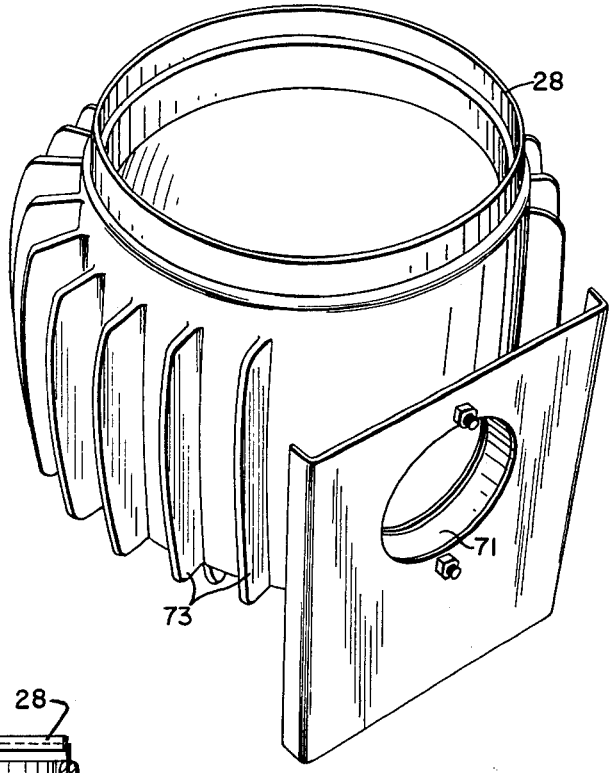
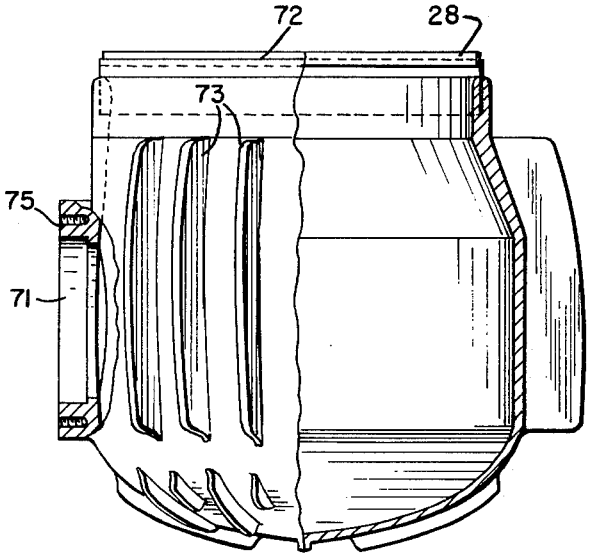
FIG. 11
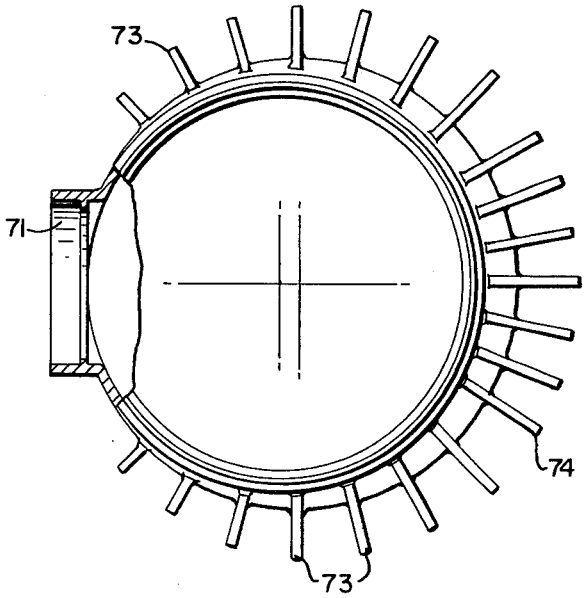
FIG. 12

HIGH EFFICIENCY FURNACE WITH LOW POLLUTING EMISSIONS

FIELD OF THE INVENTION

The present invention relates generally to domestic furnaces, and more particularly to a furnace which produces low levels of air pollutant emissions and can be tuned to operate efficiently.

BACKGROUND OF THE INVENTION

Typical modern, domestic fluid-fired furnaces are designed and operated with flue gas smoke as the only pollutant emission consideration. Field studies on No. 2 fuel oil fired furnaces have revealed that existing furnaces of conventional design produce a relatively high average of approximately 1.8 grams $NO_x$ (as nitric oxide) per kilogram of fuel oil burned when tuned to the industry accepted operating conditions producing less than No. 1 Bacharach smoke. These furnaces typically have uncooled refractory-lined fireboxes that maintain high combustion temperatures which, in turn, aid in the complete combustion of carbonaceous compounds, thus avoiding the excessive production of carbonaceous pollutants (e.g., smoke and carbon monoxide).

High flame zone temperatures also help to stabilize combustion and prevent excessive combustion-generated noise. This uncooled type of firebox design, i.e., higher combustion zone temperature, is a major influence upon the resulting high oxides of nitrogen emissions from existing furnaces. To reduce heat losses out the flue, i.e., increase thermal efficiency, burner operation is targeted for minimum excess air, which has led to the introduction of flame retention burners. However, higher adiabatic flame temperatures result from lower excess air conditions, and this, coupled with the increased combustion gas residence time induced by the intense recirculation and mixing characteristic of the typical flame retention devices, promotes the formation of even higher flue gas concentrations of oxides of nitrogen.

When an oil burner is being fired, exhausted product gases carry off substantial sensible heat and the heat of vaporization of combustion generated water vapor. This convection of heat up the flue is the greatest source of thermal inefficiency in residential space heating. Flue gas sensible heat losses may be reduced by lowering excess air in the burner or by lowering flue gas temperatures or both. Steady state thermal efficiencies could be increased by 5 to 10% simply by reducing the flow of air required by the burner. However, if the air flow is reduced to less than some nominal value (typically 20 to 50% for conventional furnaces), furnace operation is constrained by carbonaceous pollutant formation. Similarly, steady-state efficiency could be increased by 10 to 15% by lowering flue exhaust temperature. This approach, in conventional residential heating systems, is constrained considerably by the reliance on the stack effect to provide an adequate draft in the firebox and by corrosion problems if combustion-generated moisture and acids are allowed to condense in the furnace, flue or chimney.

Typically, heated and humidified living-space air is used for burner combustion air and for air that is drawn into the furnace flue through a barometric draft control device. The use of living-space air for these purposes contributes to overall residence thermal inefficiency, since the conditioned air so used is replaced by infiltrating ambient outdoor air into the living-space.

When a burner is not being fired, the stack effect induces a natural draft flow of air through the burner, firebox, heat exchanger and flue. Warm furnace components are cooled by this flow and, again, heat is lost up the flue. This loss can reduce net thermal efficiency by as much as 5% and is perhaps, the largest of several transient heat losses which cause cycle averaged efficiencies to be lower than steady state values.

The flue gases of a residential oil furnace should conform approximately with the following air pollutant emission criteria:

- carbon monoxide emissions, no greater than 1.0 g/kg of fuel burned,
- unburned hydrocarbons, no greater than 0.1 g/kg of fuel burned,
- nitrogen oxides, no greater than 0.5 g (as NO)/kg of fuel burned,
- smoke, no greater than Bacharach no. 1.

Achieving the pollutant criteria involves: optimizing combustion zone conditions; eliminating burner start spike emissions of carbon monoxide, smoke and unburned hydrocarbons; and reducing substantially the steady-state $NO_x$ emission level.

It is, accordingly, an object of the present invention to provide a new and improved fluid fired domestic furnace that approximately meets the stated pollution criteria and is highly efficient.

A further object of the invention is to provide a new and improved oil fired, domestic furnace that is more efficient and less polluting than existing furnaces, and which does not require substantial departures from design and operating principles of existing furnaces.

Another object of the invention is to provide a new and improved oil fired, domestic furnace that uses a relatively small amount of fuel.

An additional object is to provide a new and improved oil fired, domestic furnace having minimum start spikes.

BRIEF DESCRIPTION OF THE INVENTION

In accordance with one aspect of the invention, the burner and firebox are configured to approximately meet the aforementioned pollution and emission criteria. In particular, the oil burner does not include a flame retention device. Rather, the burner is provided with a choke plate having a diameter related quantitatively to the burner firing rate; in one embodiment, wherein the firing rate is one ml/sec,* the choke diameter is one and one-half inches. Further, oversized, internal peripheral air swirler vanes oriented at 25° relative to the flame axis are provided. It was found that the 25° angle gave the best compromise between smoke emissions and nitric oxide emissions, while the aforementioned choke diameter produced minimum nitric oxide emissions.

*A burner firing rate of 1.00 ml/sec corresponds to a rate of 0.951 U.S. gallons/hour.

To approximately meet the pollution criteria, the firebox is designed such that 20–25% of the higher heating value of the fuel is extracted through the firebox walls. Further, it is necessary for the firebox to retain a substantial amount of the heat that is produced therein while the burner is off or in a standby position. To these ends, and to provide a proper match for the 1 ml/sec burner, an uninsulated firebox having a relatively large internal diameter (approximately 12 inches) with radially extending fins is utilized.

In accordance with another aspect of the invention, greater efficiency and lower fuel consumption are achieved by introducing outside, relatively cold air into (1) a fluid fuel burner, particularly an oil burner, and (2) the flue, through a pressure-controlled damper for draft purposes. It has been found that fuel utilization efficiency can be raised by 10% or more by using a sealed air system to bring in outdoor ambient air for flue draft and burner combustion.

The problem of a natural draft flow through the burner, firebox, heat exchanger and flue when the burner is not being fired is accentuated when outside air is employed because there is greater cooling of the furnace components by the cold air. In accordance with a further aspect of the invention, draft air loss is substantially eliminated by providing a positive shut-off device, in the form of another damper, i.e., flapper valve, in the flow passage leading from the outside air to the burner. The damper is open only while the burner is in operation in response to air being sucked into the burner by a fan that is activated simultaneously with the burner. An estimated fuel savings of between 2 and 5% results from use of this device. Additionally, by maintaining the furnace components warmer between operating cycles of the burner, there is a reduction in the amplitude of a starting spike of excessive carbonous emissions which results when the burner is initially ignited.

In accordance with another aspect of the invention, a filter is provided for the combustion air supplied to the burner. The filter is important because the burner is tuned for operation with close to minimum (10–15%) excess air. The accumulation of foreign substances, such as lint, hair, etc. on the fan might cause sufficient change in combustion air flow to alter the operating conditions and deviate from the pollution criteria set forth above, particularly with regard to smoke and carbon monoxide.

To provide a smooth flow of air into the burner, when the burner is initially ignited, and to minimize noise due to ordered vibrations, a fan in the conduit leading to the burner includes stationary vane means that is arranged relative to blades of the fan to provide a relatively smooth flow of exterior air to the burner during initial and steady operation of the fan and the burner. A single edge of the vane means is positioned to extend simultaneously across the tips of a plurality of the blades so that air circulated by the blades simultaneously crosses the single edge as the air flows to the burner. Preferably, the blades are mounted on a squirrel cage rotor forming a centrifugal fan.

The above and still further objects, features and advantages of the present invention will become apparent upon consideration of the following detailed description of one specific embodiment thereof, especially when taken in conjunction with the accompanying drawing.

BRIEF DESCRIPTION OF THE DRAWING

FIGS. 1 and 2 are side and front views respectively of a furnace including the features of the present invention;

FIG. 10 is a perspective view of a combustion chamber, i.e., firebox, utilized in the furnace;

FIG. 11 is a partial side view and partial sectional view of the firebox illustrated in FIG. 10; and FIG. 12 is a top view of the firebox.

DETAILED DESCRIPTION OF THE DRAWING

Figure 3:
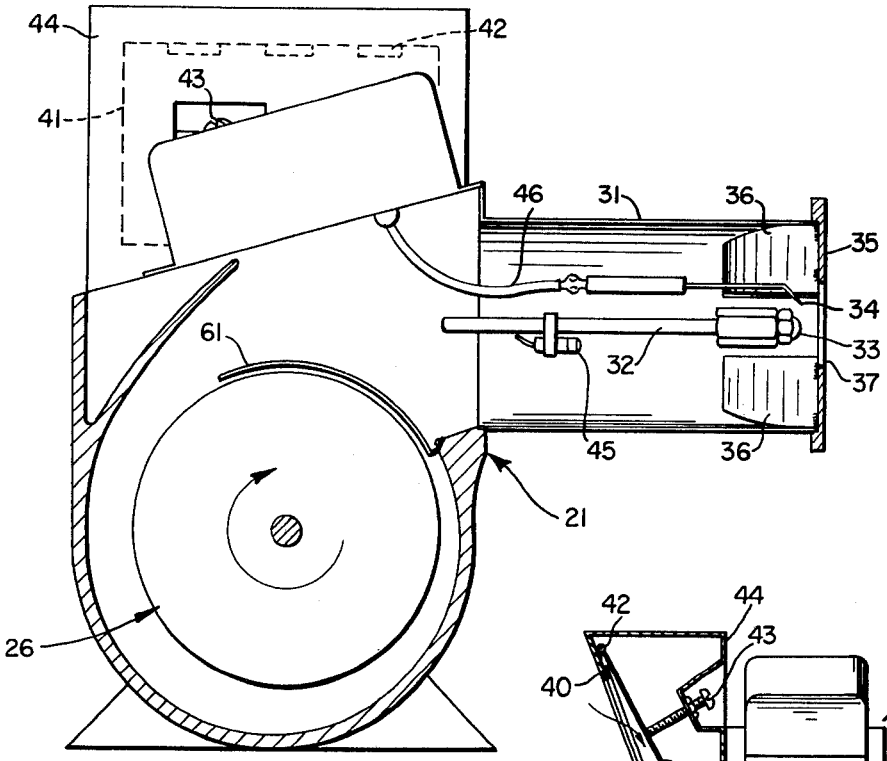
FIG. 3 is a side view of a burner and fan incorporating features of the invention.
Figure 4:
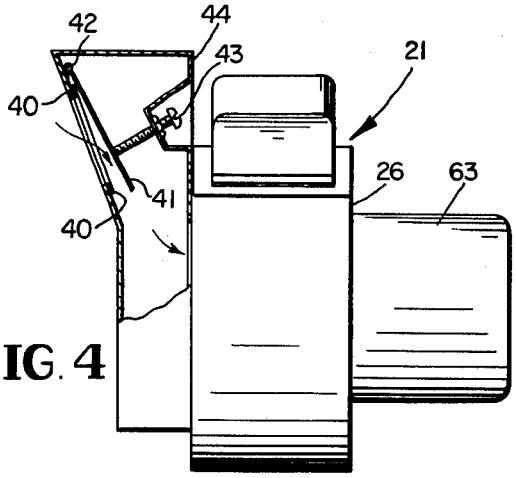
FIG. 4 is a front view of the burner and fan.

Reference is now made to FIGS. 1 and 2 of the drawing wherein there is illustrated a domestic, oil fired furnace having a sheet metal housing 11, in the form of a right parallelpiped. Air to be heated by the furnace is sucked through a floor or bottom inlet 12 past a filter (not shown) by a motor driven air blower 13, in the bottom of housing 11. The air drawn through inlet 12 by blower 13 flows through orifice 14 past firebox, i.e., combustion chamber, 15, which is mounted immediately above orifice 14. Positioned immediately above firebox 15 is a heat exchanger 16, above which is positioned a warm air outlet 17 that is connected to the volume to be heated (typically a single or two-family dwelling) by a duct system including duct 18.

The air passing heat exchanger 16 is heated by combustion products formed inside firebox 15. The products of combustion are formed by oil burner 21 that is supplied with outside air by conduit 22, extending through wall 20 of the dwelling. Conduit 22 supplies the outside air to a sealed container 23. A portion of the air in sealed container 23 is drawn from the container through conduit 24, filter 25, vestibule 30 and damper 41 into burner 21 by centrifugal fan 26. A completely sealed path for the outside air exists from the inlet of conduit 22, to container 23, through conduit 24 and filter 25 into sealed vestibule 30, through damper 41 and thence to burner 21 so that only relatively cold outside air is introduced into the burner and no warm moist air from the dwelling is consumed by the furnace. Filter 25 prevents airborne particles, e.g., lint or hair, from reaching fan 26 and burner 21. The filter prevents degradation of fan 26 performance due to the accumulation of the particles on an air scroll or blades. Because the burner is tuned for maximum performance with close to minimum (10–15%) excess air, such degradation of fan performance might cause increased smoke or carbon monoxide emissions from burner 21.

As seen infra, fan 26 is provided with a quiet stator plate to minimize noise vibrations and to smooth combustion air flow fluctuations to burner 21 during start up and steady state operations. By providing a smooth flow of air to burner 21, there is a decrease in smoke and carbon monoxide emissions.

As seen infra, an air plenum 44 is provided at the inlet to fan 26. Plenum 44 is provided with a damper that is weighted to close automatically when burner 21 is deactivated. By automatically closing the damper while burner 21 is not fired, heat losses from firebox 15, heat exchanger 16 and flue 27 that is connected to the interior of the heat exchanger, are minimized because the natural draft flow of outside air through these components is prevented.

Firebox 15 is responsive to the combustion products formed by burner 21. The gases of combustion in firebox 15 are coupled by ring 28 to the interior of heat exchanger 16, and thence are coupled through flue 27 and sealed container 23 to chimney 28. Container 23 includes a pressure responsive damper 29 that is open to admit the outside air in conduit 22 to regulate the draft in flue 27 and firebox 15. By utilizing outside air (rather than inside air) for burner 21, as well as to regulate the draft in conduit 27 and chimney 28, there is approximately a 10% savings in fuel over conventional furnace installations.

Burner 21 and firebox 15 are arranged so that there is an optimization of pollutant emissions. To this end, burner 21 does not include a flame retention device. Instead, it has a choke plate 35 having a central aperture having diameter related quantitatively to the burner firing rate, and oversized internal peripheral swirler vanes that were found to give the best compromise between smoke emissions and nitric oxide emissions. The optimized choke diameter produces minimum nitric oxide emissions for the firing rate of burner 21. Firebox 15 is matched to burner 21 to assist in establishing the optimum pollutant emissions. To this end, the firebox has a relatively large internal diameter and is cooled, by virtue of having a multiplicity of radially extending fins. Firebox 15 includes an inlet that is radially disposed with respect to the axis of the cylindrical firebox and is adapted to receive the horizontally extending flame from burner 21. It is to be understood that burner 21 can be mounted underneath firebox 15, so that its flame extends into the firebox coaxially with a common vertical, longitudinal axis of the firebox and heat exchanger 16. Such a configuration reduces eddies and vortex currents in the firebox and heat exchanger to promote efficiency and reduce pollutants.

Reference is now made to FIG. 3 of the drawing wherein there is schematically illustrated an optimized oil burner of the type preferably employed as burner 21 in FIGS. 1 and 2. The burner is preferably a gun type pressure atomizing burner of a type that is commercially available, whereby many details of the burner are not disclosed. Instead, only the important parts of the burner, and the modifications which contribute to decreased pollutant emissions, are illustrated and described. The burner includes a cylinder 31 in which are located an axially extending oil line 32 that is terminated by nozzle 33. In close proximity to nozzle 33 are a pair of ignition electrodes 34.

Figure 5:
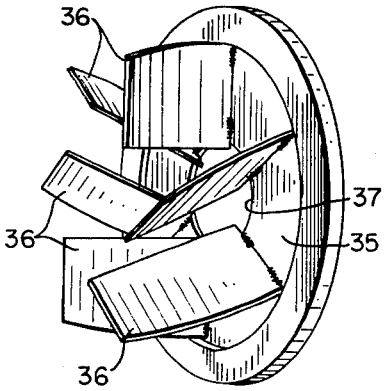
FIG. 5 is a perspective view of an optimized head utilized in the burner.
Figure 6:
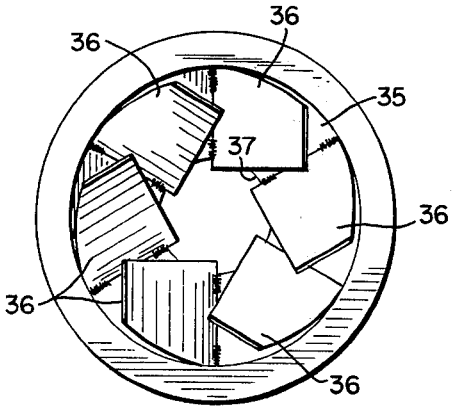
FIG. 6 is a plan view of the head illustrated in FIG. 5.

The end of cylinder 31 in proximity to nozzle 33 and electrode 34 is choked by plate 35, having a circular aperture 37 with a diameter of 1½ inches, an aperture size that produces minimum nitric oxide emissions for a burner fuel rate of 1 ml/sec. The optimum aperture diameter is related to the burner firing rate by the following formula:

$$D_a = [2.7\ \dot{\omega}_{oil}]^{0.4}$$

where $D_a$ is aperture diameter in inches and $\dot{\omega}_{oil}$ is burner firing rate in gallons per hour of no. 2 fuel oil. The formula applies to burners in the firing range of 0.5 to 12 gallons/hour. Surrounding nozzle 33 are six oversized swirler vanes 36 that are equispaced around the periphery of aperture 37 and within cylinder 31. Vanes 36 extend radially into aperture 37 a slight amount. Vanes 36 extend generally in a radial direction relative to the axis of cylinder 31 and the axis of the flame derived from nozzle 33; however, the vanes are oriented at 25° relative to this axis, as seen in FIGS. 5 and 6. It was found that the 25° angle provided the best compromise between smoke emissions and nitric oxide emissions with the 1 ml/sec fuel rate.

Outside air is delivered to nozzle 33 by conduits 22 and 24, container 23, through filter 25, vestibule 30 and plenum 44 by cengtrifugal fan 26. The air, as it is drawn into plenum 44, passes through damper, i.e., flap valve, 41 that is mounted to pivot about shaft 42. Shaft 42 is at the top of damper flap 41 and gasket 40 is positioned approximately 7° off of vertical so that the periphery of the flap is closed against gasket 40 when no air is blown by fan 26 into cylinder 31. To limit the rotation of damper 41 while it is open and thus to control air flow to burner 21, an adjustable stop screw 43 is mounted through the back wall of plenum 44. Air drawn past flap valve 41 by fan 26 causes flap 41 to open sufficiently that the back side of flap 41 is seated firmly against the end of stop screw 43. Damper 41, in conjunction with stop screw 43, provides a means for adjusting and regulating the flow of combustion air to burner 21. Damper 41 is located upstream of fan 26 so that no major difficult modifications of burner 21 are necessary. It is to be understood that damper 41 can be located between fan 26 and burner 21; this configuration has certain advantages as described in the commonly assigned, co-pending application of Allan S. Okuda et al, entitled "Fan Particularly Adapted for Pumping Air to Furnace Burners" Ser. No. 777,232, filed Mar. 14, 1977, now abandoned.

The primary control unit for activating igniter 34 employs a solid state, interrupted spark ignition (on for start) device (not shown) responsive to a flame detection cell 45 that is positioned to respond to the combustion products resulting from a flame being derived from the ignition of the combustion products at nozzle 33. The solid state ignition device supplies a starting voltage pulse to wires 46 that are connected to electrode 34. Simultaneously with activation of electrodes 34, fan 26 and fuel flow are started.

Figure 8:
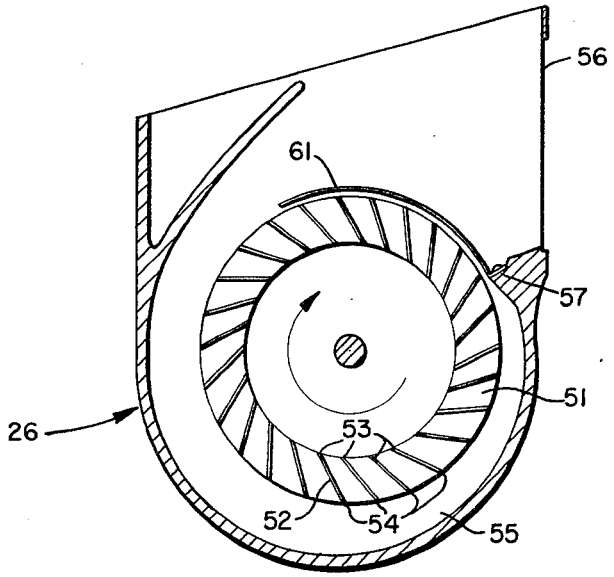
FIGS. 8 and 9 are side and front views of the fan illustrated in FIG. 7.
Figure 9:
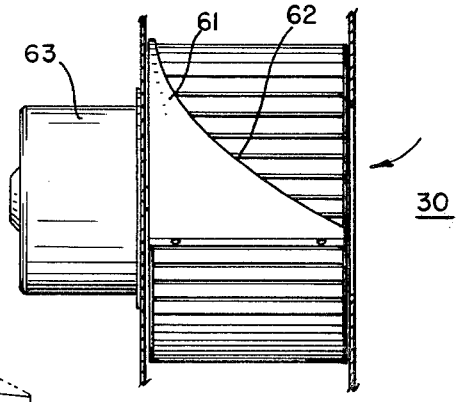
Figure 7:
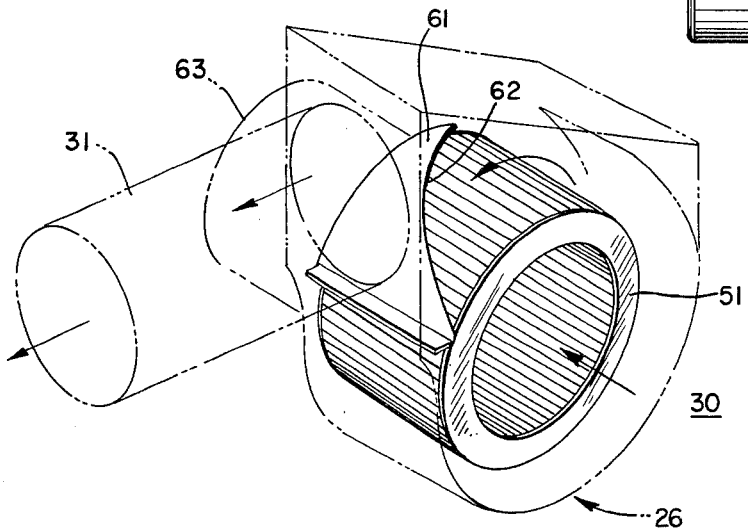
FIG. 7 is a perspective view of a fan in accordance with a feature of the invention.

Reference is now made to FIGS. 7–9 wherein there is illustrated a preferred configuration for fan 26. The fan includes a squirrel cage rotor 51 having a multiplicity of generally radially extending blades 52 that have planar or curved surfaces extending generally parallel to the axis of the squirrel cage rotor. The spacing between adjacent blades 52 is relatively close so that there is overlap between root 53 and tip 54 of adjacent blades. Air flows into the interior of rotor 51, in a direction generally parallel to the axis of the rotor, from plenum 44. The air pumped by rotor 51 flows generally radially outwardly of the rotor, through blades 52 into volute, i.e., scroll, 55. The air in volute 55 passes through a relatively wide mouth outlet 56 and thence into cylinder 31. Lip 57 extends parallel to and lies outside of rotor 51 and is positioned at the lower edge of outlet 56, to provide a baffle between outlet 56 and the smallest cross sectional area portion of the volute. Volute 55 has a continuously increasing cross section from its region immediately below lip 57 to outlet 56.

To provide a smooth flow of air through outlet 56 during initial start up conditions of fan 26, as well as during steady state operation, and to minimize ordered sound due to discrete impulses of air delivered by fan 26 into cylinder 31, a vane, i.e., stator plate 61, coaxial with rotor 51, is mounted integrally with lip 57, immediately upstream of outlet 56. Stator plate 61 is maintained in close proximity to the tips 54 of blades 52. Stator plate 61 has a tapered edge 62 that simultaneously extends across the tips of many of the blades of rotor 51. In the configuration illustrated in FIGS. 7–9, edge 62 simultaneously intercepts the tips of 11 different blades.

Thereby, air circulated by a plurality of blades 52 simultaneously crosses edge 62 as the air flows to the burner.

The spacing between tips 54 of blades 52 and the inner edge of lip 57, as well as the inner diameter of vane 61, is on the order of 62 mils, which is approximately one fourth the gap between the blade tips and the inside edge of lip 57 of prior art fans. Prior art burner fan casings have had a relatively large gap between the casing and the blade tip to avoid the relatively high frequency (approximately 500 to 1000 Hz) burner noise problems that result from the fan tip to casing interaction. However, because of the tapered edge 62 that is employed with the present invention, these noise problems are substantially eliminated and closer spacing between vane 61 and tips 54 is achieved. Of course, close spacing between vane 61 and tips 54 is desirable to provide a greater baffle effect between the low and high pressure portions of volute 55 and to increase the output pressure of the fan. Because vane 61 is integral with lip 57, the vane and tip, together, can be thought of as a variable length baffle between outlet 56 and the smaller cross sectional portion of volute 55.

Edge 62 is arranged so that the vane has a minimum length adjacent the edge of the rotor where air is introduced into the interior of the rotor from plenum 44. Maximum length of the vane is on the opposite edge of rotor 51, where the rotor is connected to an output shaft of electric driving motor 63. Edge 62 can have a straight taper, or the taper can be skewed or curved. Skewing or curving the edge 62 may be advantageous in certain situations to minimize certain high frequency components in the air supplied by fan 26 to burner 21.

By arranging edge 62 so that it simultaneously intersects the tips of many of blades 52, discrete pressure pulses, i.e., noise, which results from a single blade intersecting a single edge, is reduced. Without edge 62, the entire surface of each blade tip would pass lip 57 at one time to produce many air flow step functions and many high frequency harmonics of considerable amplitude. Because a small surface of each blade intersects edge 62 at any time the amplitude of the step function is reduced considerably. Further, because of the spacing between different segments of edge 62 and outlet 56, the different noise components arrive with different, random phases at the outlet and have a tendency to cancel. Also, by curving edge 62, different frequency components are generated at different segments of edge 62 so that no component has a substantial amplitude. Any noise components that might be generated by air ejected into volute 55 upstream of edge 62 has a tendency to be smoothed by the volume of volute 55, that has a tendency to function as a low pass filter having a progressively decreasing cut-off frequency as a direct function of arcuate distance from outlet 56. Hence, tip whine is substantially eliminated. Further, there is pulse-free air flow to the burner, to reduce the likelihood of combustion instability.

Reference is now made to FIGS. 10–12 wherein a preferred configuration for firebox 15 is illustrated.

Firebox 15 is a rather massive (approximately 70 pounds) uninsulated cast iron assembly with external, radially extending fins to increase the effectiveness of the air flowing across the fins from orifice 14 to cool the firebox and the products of combustion inside of the firebox. The firebox is of generally cylindrical configuration, having a relatively large inner diameter of approximately 12 inches, particularly matched to the burner firing rate of 1 ml/sec. The relatively massive, cooled firebox 15 produces two useful results. The firebox inner surface runs at approximately 500° F. vs 2500° F. for conventional insulated construction. The reduced inner surface temperature, in combination with proper matching to the optimum burner, provides a considerable reduction in $NO_x$ emissions. In addition, the mass of the firebox, compared with conventional lightweight designs, retains heat between furnace firing cycles and, in typical on-off cyclical operation, is still warm each time the burner starts. The warm firebox reduces carbonaceous emissions typically caused by starting with a cold inner firebox surface.

Firebox 15 includes an inlet 71 that is horizontally aligned with aperture 37 of burner 21, whereby the burner choke plate 35 fits snuggly into collar 75 about opening 71. The flame from burner 21 flows radially inwardly of firebox 15 and thence gaseous products of combustion rise from the firebox through outlet 72 into heat exchanger 16. Outlet 72 is enclosed by ring 28 to feed the combustion products into heat exchanger 16. The bottom of firebox 15 has a domed configuration tapering gradually from the central, cylindrical portion of the firebox, to provide relatively uniform temperature distribution over the entire interior surface of the firebox, to eliminate hot and cold spots.

Radially extending vanes are arranged around the periphery of firebox 15 to promote transfer of heat to the heated fluid. Twenty-one heat exchanging fins 73 and 74, each having a thickness of approximately ¼ inch, are integrally cast with the outside cylindrical and domed portion of the firebox. The fins are of differing lengths, to increase the outer surface area of the firebox to approximately 4½ times the area of the unfinned cylindrical shell in the region of maximum finning.

Ring 28 and outlet 72 are eccentric, rather than concentric, to the axis of the firebox so that the firebox is shifted toward the rear wall of housing 11, without requiring a change in the position of inlet 71 or burner 26. The rear biased eccentricity of the firebox reduces the external cross-sectional area for coolant air flow at the back of the firebox, diametrically opposite to inlet 71. Because the burner flame is directed toward the back of the firebox, the hottest portion of the firebox is at its back. To compensate for the effects of the increased heat at the rear of the firebox, fins 74, at the back of the firebox, are spaced closer to each other than fins 73, around the remainder of the box. In particular, fins 74 have an arcuate spacing of approximately 10°, while the spacing of fins 73 is approximately 15°. To provide relatively uniform temperatures on the inside walls of the firebox, the length of fins 13 increases as a direct function of the distance around the perimeter of the firebox from inlet 71 because the required amount of cooling is greatest at the wall of the firebox diametrically opposite from the inlet. All of fins 74 have the same length, equal to the length of the longest of fins 73.

Firebox 15 is mated to heat exchanger 16 by rolled steel ring 28 that is cast into the top of firebox 15. Steel ring 28 is then welded around its periphery to the cylindrical sheet steel shell of heat exchanger 16. This type of firebox-heat exchanger attachment provides a permanent gas-tight joint between the cast iron firebox 15 and the sheet metal heat exchanger 16.

In laboratory tests that were conducted on the described furnace, it was demonstrated that nitrogen oxide emissions are much lower than from conventional, oil burning furnaces of the same capacity. In particular, emissions of nitric oxide were between 0.5 and 0.75 grams of nitric oxide per kilogram of fuel over the stoichiometric ratio range of interest, which represents a 65% reduction from the estimated average 1.8 grams of nitric oxide per kilogram for existing furnaces. In the stoichiometric ratio range of between 1.10 and 1.15, where the present furnace is tuned for normal operation, cycle-averaged nitric oxide emissions are only about 0.6 grams of nitric oxide per kilogram of oil burned. Carbonaceous emissions are acceptably low at these conditions. Concerning efficiency, the present invention is capable of operating at higher overall efficiency than conventional, state-of-the-art furnaces for two reasons: higher steady-state efficiency and lower heat losses during standby periods. At equivalent flue gas temperatures, the present furnace has higher steadstate efficiency because of its ability to operate with minimum excess combustion air. The flap valve damper in the burner's combustion air inlet is the principal contributer to reduced standby heat losses. In addition, the use of a sealed air system to provide outdoor air for the furnace's combustion circuit air requirements reduces a residence's thermal demand and effects a substantial fuel savings. In combination, these several features of the invention result in approximately 20 to 25% less fuel being consumed by furnaces manufactured in accordance with the present invention, relative to the average of existing furnaces having the same overall characteristics.

While there has been described and illustrated one specific embodiment of the invention, it will be clear that variations in the details of the embodiments specifically illustrated and described may be made without departing from the true spirit and scope of the invention as defined in the appended claims.

What is claimed is:

1. A domestic furnace for heating fluid that is circulated through a volume being heated comprising an oil burner, a massive metal uninsulated firebox for combustion products of the oil burner, a heat exchanger having an interior in fluid flow relationship with fluid heated in the firebox and an exterior surface for heating the circulated fluid, said firebox having an exterior surface including heat exchanger fins in heat exchange relationship with the circulated fluid so that the products of combustion in the firebox are cooled by a heat exchange between the products of combustion and the circulated fluid passing the exterior surface, said fins being arranged so that there is a substantially uniform temperature on the interior wall of the firebox to prevent hot spots from forming on the wall and thereby reduce substantially the formation of $NO_x$, a flue in fluid flow relationship with the heat exchanger interior for venting exhaust gases from the firebox and the interior of the heat exchanger to the exterior of the heated volume, a pressure controlled damper leading to said flue, a conduit extending from the exterior of the heated volume to (a) the burner for supplying exterior air to the burner, and (b) the damper for supplying exterior air to the flue.

2. The furnace of claim 1 including a further damper for preventing the flow of exterior air to the burner except while the burner is activated, whereby air in the burner and firebox does not escape to the exterior through the flue and heat is retained in the burner and firebox while the burner is deactivated.

3. The furnace of claim 2 further including an air filter in the conduit upstream of the further damper.

4. The furnace of claim 3 wherein the filter is in the conduit outside of the flow path to the damper leading to the flue.

5. The furnace of claim 2 wherein the further damper is in the conduit outside of the flow path to the damper leading to the flue.

6. The furnace of claim 1 wherein the firebox has a generally cylindrical shape and a longitudinal axis, said fins extending radially of the axis.

7. The furnace of claim 6 wherein the burner, firebox and heat exchanger have common longitudinal axes.

8. The furnace of claim 7 wherein the firebox axis is vertically disposed and the firebox has a horizontal inlet from the burner.

9. The furnace of claim 8 wherein the firebox has a vertically disposed cylindrical outlet having an axis offset relative to the firebox axis so that the outlet axis is closer to the inlet of the firebox than a portion of the firebox interior wall diametrically opposite from the firebox inlet, said fins being arranged to have a substantially greater surface area in proximity to the firebox wall portion.

10. The furnace of claim 8 wherein the fins having close proximity to the wall portion have an arcuate spacing less than the arcuate spacing of others of said fins.

11. The furnace of claim 1 wherein the firebox has a generally cylindrical shape and a vertical axis, said fins extending radially of the axis.

12. The furnace of claim 11 wherein the firebox has a vertically disposed, cylindrical outlet having an axis offset relative to the firebox axis so that the outlet axis is closer to the inlet of the firebox than a portion of the firebox interior wall diametrically opposite from the firebox inlet, said fins being arranged to have a substantially greater surface area in proximity to the firebox wall portion.

13. The furnace of claim 12 wherein the fins having close proximity to the wall portion have an arcuate spacing less than the arcuate spacing of others of said fins.

14. The furnace of claim 1 further including a fan for drawing exterior air through the conduit to the burner, said fan including stationary vane means and moving blades, said vane means being arranged relative to the blades to provide a relatively smooth flow of exterior air to the burner during initial and steady operation of the fins and burner.

15. The furnace of claim 14 wherein a single edge of the vane means is positioned to extend simultaneously across the tips of a plurality of the blades so that air circulated by a plurality of the blades simultaneously crosses the single edge as the air flows to the burner.

16. The furnace of claim 15 wherein the blades are mounted on a squirrel cage rotor having a longitudinal axis, a volute in which said rotor is mounted, an exterior air inlet through which air is drawn into the interior of the rotor, said volute including an outlet for exterior air radially ejected by the blades into the volute, a baffle between the outlet and the smallest cross-sectional area of the volute, said edge being upstream of the outlet and being on a vane generally coaxial with the rotor axis and extending from the baffle.

17. The furnace of claim 1 wherein the burner includes an end plate having an aperture through which a flame of the burner axially extends, a plurality of fixed blades extending in a generally radial direction relative to the axis of the flame, said blades being spaced about the periphery of the aperture and displaced from the radial direction to swirl the flame relative to the flame axis.

18. The furnace of claim 17 wherein the burner has a firing rate of approximately 1 ml/sec and the blades are displaced from the radial position by approximately 25° and the aperture is circular, having a diameter of approximately 1.5 inches, whereby minimum smoke and nitric oxide emissions occur.

19. The furnace of claim 1 wherein the burner includes an end plate having a circular aperture through which a flame of the burner axially extends, the burner having a predetermined firing rate, the aperture diameter being related to the firing rate by:

$$D_a = [2.7\ \dot{\omega}_{oil}]^{0.4}$$

where $D_a$ is aperture diameter in inches and $\dot{\omega}_{oil}$ is burner firing rate in gallons per hour of no. 2 fuel oil.

20. A domestic furnace for heating fluid that is circulated through a volume being heated comprising an oil burner, a massive metal uninsulated firebox for combustion products of the oil burner, a heat exchanger having an interior in fluid flow relationship with fluid heated in the firebox and an exterior surface for heating the circulated fluid, a flue in fluid flow relationship with the heat exchanger interior for venting exhaust gases from the firebox and the interior of the heat exchanger to the exterior of the heated volume, said firebox including heat exchanger fins in heat exchange relationship with the circulated fluid so that the products of combustion in the firebox are cooled by a heat exchange between the products of combustion and the circulated fluid passing the exterior surface, said fins being arranged so that there is a substantially uniform temperature on the interior wall of the firebox to prevent hot spots from forming on the wall and thereby reduce substantially the formation of $NO_x$, said burner including an end plate having an aperture through which a flame of the burner axially extends, a plurality of fixed blades extending in a generally radial direction relative to the axis of the flame, said blades being spaced about the periphery of the aperture and displaced from the radial direction to swirl the flame relative to the flame axis.

21. The furnace of claim 20 wherein the blades are displaced from a radial position by approximately 25° and the aperture is circular, having a diameter of between 1.5 and 2 inches, whereby minimum smoke and nitric oxide emissions occur.

22. The furnace of claim 20 wherein the blades are displaced from a radial position by approximately 25° and the aperture is circular, having a diameter in accordance with:

$$D_a = [2.7\ \dot{\omega}_{oil}]^{0.4}$$

where $D_a$ is aperture diameter in inches and $\dot{\omega}_{oil}$ is burner firing rate in gallons per hour of no. 2 fuel oil.

23. The furnace of claim 20 further including a pressure controlled damper leading to said flue.

24. The furnace of claim 23 further including a conduit extending from the exterior of the heated volume to: (a) the burner for supplying exterior air to the burner, and (b) the damper for supplying exterior air to the flue.

25. A domestic furnace for heating fluid that is circulated through a volume being heated comprising an oil burner, a massive metal uninsulated firebox for combustion products of the oil burner, a heat exchanger having an interior in fluid flow relationship with fluid heated in the firebox and an exterior surface for heating the circulated fluid, said firebox having an exterior surface including heat exchanger fins in heat exchange relationship with the circulated fluid so that the products of combustion in the firebox are cooled by a heat exchange between the products of combustion and the circulated fluid passing the exterior surface, said fins being arranged so that there is a substantially uniform temperature on the interior wall of the firebox to prevent hot spots from forming on the wall and thereby reduce substantially the formation of $NO_x$, and a flue in fluid flow relationship with the heat exchanger interior for venting exhaust gases from the firebox and the interior of the heat exchanger to the exterior of the heated volume.

26. A domestic oil furnace for heating a fluid that is circulated from a volume being heated to the furnace, through the furnace and back to the volume being heated, the furnace comprising:

an oil burner for producing a flame, an air filter upstream of the burner for substantially removing particulate matter in the air flowing to the burner, a massive metal uninsulated firebox in fluid flow relationship with the burner to be responsive to the flame for producing combustion products, said firebox having an interior surface heated by said combustion products and an exterior surface cooled by said circulated fluid passing over it so there is a heat exchange through the firebox wall between the fluid and the interior surface, said firebox having an exterior surface including heat exchanger fins in heat exchange relationship with the circulated fluid so that the products of combustion in the firebox are cooled by a heat exchange between the products of combustion and the circulated fluid passing the exterior surface, said fins being arranged so that there is a substantially uniform temperature on the interior wall of the firebox to prevent hot spots from forming on the wall and thereby reduce substantially the formation of $NO_x$, a heat exchanger, said heat exchanger having an interior surface in fluid flow relationship with said combustion products inside said firebox and an exterior surface for heating said circulated fluid, flue means in fluid flow relationship with the interior of said heat exchanger for venting combustion products from the interiors of said firebox and said heat exchanger to the outside of the heated volume, said burner means being arranged so the flame is in a substantially stoichiometric ratio range to minimize generation of $NO_x$ pollutants within said firebox.

27. The furnace of claim 26 wherein said burner includes an end plate having an aperture through which a flame of the burner axially extends, a plurality of fixed blades extending in a generally radial direction relative to the axis of the flame, said blades being spaced about the periphery of the aperture and displaced from the radial direction to swirl the flame relative to the flame axis.

28. The furnace of claim 27 wherein the blades are displaced from a radial position by approximately 25° and the aperture is circular, having a diameter of between 1.5 and 2 inches, whereby minimum smoke and nitric oxide emissions occur.

29. The furnace of claim 27 wherein the blades are displaced from a radial position by approximately 25° and the aperture is circular, having a diameter in accordance with:

$$D_a = [2.7\ \dot{\omega}_{oil}]^{0.4}$$

where $D_a$ is aperture diameter in inches and $\dot{\omega}_{oil}$ is burner firing rate in gallons per hour of no. 2 fuel oil.

30. The furnace of claim 26 wherein the firebox is matched to the burner such that the amount of excess air required to complete combustion is minimized.

31. The furnace of claim 26 wherein the firebox is constructed to extract about 25% of the heating value of the fuel.

32. The furnace of claim 31 wherein air is the circulated fluid, and the firebox is constructed so that the interior surface thereof is maintained at a temperature on the order of 500° F.

33. The furnace of claim 26 including a damper for preventing the flow of exterior air to the burner except while the burner is activated, whereby air in the burner and firebox does not escape to the exterior through the conduit and heat is retained in the burner and firebox while the burner is deactivated.

34. The furnace of claim 33 further including an air filter in the conduit upstream of the further damper.

35. The furnace of claim 34 wherein the filter is in the conduit outside of the flow path to the damper leading to the flue.

36. The furnace of claim 26 further including a pressure controlled damper leading to said flue, a conduit extending from the exterior of the heated volume to: (a) the burner for supplying exterior air to the burner, and (b) the damper for supplying exterior air to the flue.

* * * * *